US006323170B1

(12) United States Patent
Wierenga et al.

(10) Patent No.: US 6,323,170 B1
(45) **Date of Patent: *Nov. 27, 2001**

(54) FLOOR CLEANERS WHICH PROVIDE IMPROVED BURNISH RESPONSE

(75) Inventors: Thomas James Wierenga; Jeffrey Scott Weaver, both of Cincinnati, OH (US)

(73) Assignee: The Procter & Gamble Co., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/347,641

(22) Filed: Jul. 6, 1999

Related U.S. Application Data

(63) Continuation-in-part of application No. 08/781,316, filed on Jan. 9, 1997, now Pat. No. 5,990,064, which is a continuation-in-part of application No. 08/438,939, filed on May 10, 1995, now Pat. No. 5,691,291, which is a continuation-in-part of application No. 08/330,633, filed on Oct. 28, 1994, now abandoned.

(51) Int. Cl.[7] ..... C11D 1/75; C11D 9/36

(52) U.S. Cl. ..... 510/214; 510/199; 510/212; 510/237; 510/245; 510/332; 510/333; 510/340; 510/356; 510/362; 510/363; 510/421; 510/466; 510/503; 510/347

(58) Field of Search ..... 510/214, 199, 510/212, 237, 245, 332, 333, 340, 356, 362, 363, 421, 466, 503, 347

(56) References Cited

U.S. PATENT DOCUMENTS

| | | | | |
|---|---|---|---|---|
| H1635 | * | 3/1997 | Vander Meer | 510/220 |
| 3,223,647 | | 12/1965 | Drew et al. | 252/137 |
| 3,233,986 | | 2/1966 | Morehouse | 44/76 |
| 3,235,509 | | 2/1966 | Nitzsche et al. | 252/358 |
| 3,455,839 | | 7/1969 | Rauner | 252/321 |
| 3,511,788 | | 5/1970 | Keil | 260/2.5 |
| 3,746,653 | | 7/1973 | Churchfield | 252/321 |
| 3,925,262 | | 12/1975 | Laughlin et al. | 252/526 |
| 4,174,304 | * | 11/1979 | Flanagan | 252/524 |
| 4,284,532 | | 8/1981 | Leikhim et al. | 252/528 |
| 4,285,841 | | 8/1981 | Barrat et al. | 252/559 |
| 5,096,610 | | 3/1992 | Bingham | 252/162 |
| 5,342,551 | | 8/1994 | Ruckle | 252/548 |
| 5,545,340 | * | 8/1996 | Wahl et al. | 510/517 |
| 5,562,849 | * | 10/1996 | Wahl et al. | 510/521 |
| 5,691,291 | * | 11/1997 | Wierenga et al. | 510/214 |
| 5,866,532 | * | 2/1999 | Jackson et al. | 510/466 |
| 5,965,514 | * | 10/1999 | Wierenga et al. | 510/433 |
| 5,968,889 | * | 10/1999 | Wierenga | 510/423 |
| 5,977,054 | * | 11/1999 | Wierenga | 510/503 |
| 5,981,466 | * | 11/1999 | Morelli et al. | 510/499 |
| 5,990,064 | * | 11/1999 | Wierenga et al. | 510/214 |

FOREIGN PATENT DOCUMENTS

| | | | |
|---|---|---|---|
| 0 611 214 A2 | 8/1994 | (EP) | C11D/7/50 |
| 437566 | 10/1935 | (GB) . | |
| 1373903 | 11/1974 | (GB) | C08G/47/02 |

* cited by examiner

*Primary Examiner*—Yogendra N. Gupta
*Assistant Examiner*—Charles Boyer
(74) *Attorney, Agent, or Firm*—Erich D. Hemm; Carl J. Roof

(57) ABSTRACT

No-rinse floor cleaning compositions which provide improved burnish response to finished floors are sold in concentrated form or in diluted, ready to use form. The concentrated compositions when diluted with water comprise from about 100 ppm to about 750 ppm of an amine oxide surfactant, from about 0 ppm to about 650 ppm of a nonionic surfactant, and from about 1 ppm to about 40 ppm of a silicone antifoam agent. These floor cleaning compositions are substantially free of harsh chemicals and are particularly suitable for use on highly polished floors in commercial environments where daily burnishing is most often utilized.

4 Claims, No Drawings

FLOOR CLEANERS WHICH PROVIDE IMPROVED BURNISH RESPONSE

CROSS REFERENCE TO RELATED APPLICATIONS

This is a continuation-in-part of U.S. patent application Ser. No. 08/781,316, filed Jan. 9, 1997, and issued Nov. 23, 1999 as U.S. Pat. No. 5,990,064; which is a continuation-in-part of U.S. patent application Ser. No. 08/438,939, filed May 10, 1995, and issued Nov. 25, 1997 as U.S. Pat. No. 5,691,291; which is a continuation-in-part of U.S. patent application Ser. No. 08/330,633, filed Oct. 28, 1994, now abandoned.

FIELD OF THE INVENTION

This invention pertains to floor cleaning compositions, more particularly to concentrated; no rinse compositions for use on finished floors in the commercial market. These compositions consist essentially of an amine oxide detergent surfactant, a nonionic detergent surfactant, and a silicone antifoam agent. These floor cleaners provide enhanced burnish response which gives floors a higher gloss while extending finish lifetimes. In addition, these floor cleaners provide significantly better cleaning performance on particulate soils and leave little or no visible residue.

BACKGROUND OF THE INVENTION

There are basically two types of floor finishes found in the commercial market. The first type is a "high gloss or wet look finish" which, typically, is found on supermarket floors. The high gloss gives a positive visual impression of cleanliness and healthiness. This type of finish requires more effort to maintain in that it must be burnished or polished daily to maintain its high gloss.

The second type of commercial floor finish is a "durable finish" which, typically, is found on floors in office buildings, schools and hospitals. The durable finish does not exhibit as high a gloss so it requires less effort to maintain because it does not have to be burnished on a daily basis.

Dilute floor stripping compositions or specifically formulated burnishing solutions are widely used for polishing commercial floors. Commercial floors are usually composed of vinyl tiles that have been protected with a polyacrylic acid based finish. Dilute strippers or burnishing solutions are often applied to the floor to slightly soften the polyacrylic acid finish before burnishing (high speed polishing). The problem with this approach is that these compositions can contain harsh chemicals that can cause damage and reduce the lifetime of the floor finish if the burnishing solution is overused. Modern polyacrylic finishes contain metal ions as crosslinking agents to strengthen the finish. If a cleaning or burnishing composition containing a harsh chemical(s) is applied to the finish, the metal ions that crosslink the finish can be removed weakening the finish so it is abraded (damaged) rather than polished during the burnishing process.

U.S. Pat. No. 5,096,610 discloses a composition for removing floor finish which contains a solvent, water, and an organosilicon complex.

U.S. Pat. No. 5,342,551 discloses a noncaustic floor finish removal composition containing monoethanolamine citrate, couplers, and solvents. These compositions have a pH of between 8 and 10.

EP 611,214A2 discloses acidic compositions useful for removing floor finishes having a pH of from about 2 to about 5.

It has surprisingly been discovered that compositions utilizing specific surfactants, in combination with other components disclosed hereinafter, are useful as floor cleaners which are substantially free of harsh chemicals and which provide improved burnish response. Such improved burnish response provides floors with a higher level of gloss which is achieved in a shorter period of time with less effort while extending the finish lifetimes versus conventional products.

SUMMARY OF THE INVENTION

The present invention is directed to a no-rinse floor cleaning composition which provides improved burnish response when used on finished floors. The composition can be sold in a concentrated form or in ready-to-use (RTU) diluted form. The concentrated compositions are formulated to be diluted with water before use. The RTU formulas are intended to be used as-is. The concentrated compositions comprise a) from about 1% to about 15% of an amine oxide surfactant, b) from about 0% to about 15% of a nonionic surfactant, and c) from about 0.01% to about 0.5% of a silicone antifoam agent. Both the concentrate (when diluted) and the RTU formulation provide a) from about 100 ppm to about 750 ppm of an amine oxide surfactant, b) from about 0 ppm to about 650 ppm of a nonionic surfactant, and c) from about 1 ppm to about 40 ppm of a silicone antifoam agent when used to clean a finished floor. Said floor cleaning compositions are substantially free of harsh chemicals and are particularly suitable for use on highly polished floors in commercial environments (supermarkets, discount stores, department stores) where daily burnishing is most often utilized. The compositions provide improved burnish response to finished floors by temporally softening the finish just enough to aid burnishing without damaging the finish. These compositions have a pH of from about 3 to about 10, preferably from about 5 to about 10, and most preferably from about 7.5 to about 10. The concentrated compositions preferably are diluted by the end user at a ratio of from about 1:16 to about 1:512 parts cleaning composition to water.

DETAILED DESCRIPTION OF THE INVENTION

The concentrated and dilute, ready-to-use floor cleaning compositions of the present invention comprise (1) amine oxide detergent surfactant, (2) silicone antifoam agent, and (3) optionally a nonionic detergent surfactant. These compositions have a pH of from about 3 to about 10, preferably from about 5 to about 10, more preferably from about 7 to about 10, and most preferably from about 7.5 to about 10.

As used herein, the term "burnish response" refers to a measurement of the amount of light reflected from a surface at certain angles (20°, 60°, and 85°). Burnish response is measured using a gloss meter which is manufactured by Hunter Laboratories, Reston, Va. The burnish response as used herein was determined by measuring the level of gloss on the floor before and after cleaning.

As used herein, the term "concentrated" refers to compositions which are formulated in non-diluted formulas for sale, shipping, and storing. These non-diluted formulas are designed to be diluted with water just before being used to clean floors.

As used herein, the terms "diluted" and "ready-to-use" refer to compositions which are meant to be used as-is without dilution.

All percentages, parts and ratios are based upon the total weight of the floor cleaning compositions of the present invention, unless otherwise specified.

Amine Oxide Detergent Surfactant

The floor cleaning compositions of the present invention comprise an amine oxide detergent surfactant. Without being bound by theory, the amine oxide detergent surfactant is the primary cleaning ingredient which promotes enhanced burnish response by temporarily softening the polyacrylic finish on the surface of the floor. Amine oxide surfactants hydrate the finish by pulling water into it. The hydrated finish is softer which allows for better burnish response. As the water evaporates, the finish rehardens. Since the structure (metal ion crosslinking) of the finish has not been modified, the floor finish can be burnished without being abraded (damaged). Since there is less damage to the finish, its lifetime can be extended versus traditional burnishing solutions.

The concentrated compositions disclosed herein comprise from about 1% to about 15%, preferably from about 2% to about 10%, more preferably from about 30% to about 5%, of the amine oxide surfactant as reported on a 100% active basis. The concentrated composition as diluted and the ready to use formula both provide from about 100 ppm to about 750 ppm, preferably from about 100 ppm to about 700 ppm, more preferably from about 100 ppm to about 300 ppm, of the amine oxide detergent surfactant in the solution used to clean a floor. The amine oxide preferably has the formula $R_1R_2R_3NO$, where $R_1$, is a straight or branched chain, substituted or unsubstituted alkyl or alkenyl group containing from about 8 to about 30, preferably from about 8 to about 18, carbon atoms. $R_2$ and $R_3$ are each substituted or unsubstituted alkyl or alkenyl groups containing from about 1 to about 18, preferably from about 1 to about 4, carbon atoms. More preferably, $R_2$ and $R_3$ are each methyl groups, examples of which include dodecyldimethyl amine oxide, tetradecyldimethyl amine oxide, hexadecyldimethyl amine oxide, octadecyldimethyl amine oxide, and coconut alkyl dimethyl amine oxides.

The amine oxide detergent surfactant can be prepared by known and conventional methods. One such method involves the oxidation of tertiary amines in the manner set forth in U.S. Pat. No. 3,223,647 and British Patent 437,566, which disclosure is incorporated by reference herein. In general terms, amine oxides are prepared by the controlled oxidation of the corresponding tertiary amines. Such amine oxide surfactants are commercially available from the Procter and Gamble Company.

Examples of suitable amine oxide detergent surfactants for use in the compositions include octyldimethyl amine oxide, decyldimethyl amine oxide, dodecyldimethyl amine oxide, tridecyldimethyl amine oxide, tetradecyldimethyl amine oxide, pentadecyldimethyl amine oxide, hexadecyldimethyl amine oxide, heptadecyldimethyl amine oxide, octadecyldimethyl amine oxide, dodecyldiethyl amine oxide, tetradecyldiethyl amine oxide, hexadecyldiethyl amine oxide, octadecyldiethyl amine oxide, dodecyldipropyl amine oxide, tetradecyldipropyl amine oxide, hexadecyldipropyl amine oxide, octadecyldipropyl amine oxide, dodecyldibutyl amine oxide, tetradecyldibutyl amine oxide, bexadecyldibutyl amine oxide, octadecyldibutyl amine oxide, dodecylmethylethyl amine oxide, tetradecylethylpropyl amine oxide, hexadecylpropylbutyl amine oxide, and octadecylmethylbutyl amine oxide.

Preferred are amine oxide detergent surfactants which are prepared by the oxidation of tertiary amines prepared from mixed alcohol's obtainable from coconut oil. Such coconut alkyl amine oxides are preferred from an economic standpoint inasmuch as it is not necessary for the present purposes, to separate the mixed alcohol fractions into their pure components to secure the pure chain length fractions of the amine oxides. Examples of preferred coconut alkyl amine oxide surfactants for use herein include coconut decyldimethyl amine oxide, coconut dodecyldimethyl amine oxide, and coconut tetradecyldimethyl amine oxide. The most preferred amine oxide detergent surfactant for use herein is coconut dimethyl amine oxide, which is a natural blend of coconut dodecyldimethyl and coconut tetradecyldimethyl amine oxide.

Nonionic Detergent Surfactant

The floor cleaning compositions of the present invention can also comprise a nonionic detergent surfactant ("cosurfactant" herein for the preferred mixtures of detergent surfactants in the compositions) which provide cleaning and emulsifying benefits over a wide range of soils. The concentrated compositions disclosed herein comprise from about 0% to about 15%, preferably from about 1% to about 10%, more preferably from about 4% to about 6%, of the nonionic detergent surfactant. The concentrated composition as diluted and the ready to use formula both provide from about 0 ppm to about 650 ppm, preferably from about 50 ppm to about 650 ppm, more preferably from about 350 ppm to about 650 ppm, of the nonionic detergent surfactant in the solution used to clean a floor. The nonionic surfactant preferably has the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (hydrophile-lipophilic balance) of from about 10 to about 13. These surfactants are more fully described in U.S. Pat. No. 4,285,841, Barrat et al, issued Aug. 25, 1981, and U.S. Pat. No. 4,284,532, Leikhim et al, issued Aug. 18, 1981, both incorporated herein by reference. Particularly preferred are condensation products of $C_{10}$ having 5 moles of ethoxylate per mole of alcohol. Such nonionic surfactants are commercially available from the Shell Chemical Company under the trade name "Neodol 1–5".

It has been found that the combination of amine oxide surfactants and nonionic surfactants is surprisingly good for cleaning particulate soil and enhancing burnish response by providing high gloss with less damage to the finish, as compared to similar compositions. The molar ratio of nonionic detergent surfactant to amine oxide detergent surfactant in the concentrated composition should preferably be from about 1:25 to about 5:1, more preferably from about 1:5 to about 2:1, most preferably about 1:1.

Silicone Antifoam Agent

Silicone materials employed as the silicone antifoaming agents herein can be alkylated polysiloxane materials of several types, either singly or in combination with various solid materials such as silica aerogels and xerogels and hydrophobic silicas of various types. In industrial practice the term "silicone" has become a generic term which encompasses a variety of relatively high molecular weight polymers containing siloxane units and hydrocarboxyl groups of various types. In general terms, the silicone antifoaming agents can be described as containing siloxane moieties having the general structure:

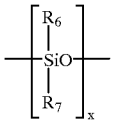

wherein x is a number from about 20 to about 2,000, and $R_6$ and $R_7$ are each alkyl or aryl groups, preferably alkyl groups containing from 1 to 4 carbon atoms. The polydimethylsiloxanes ($R_6$ and $R_7$ are methyl) having a molecular weight within the range of from about 200 to about 200,000, and higher, are all useful as antifoaming agents. Such silicone materials are commercially available from the Dow Corning Corporation under the trade name "Silicone 200 Fluids".

Additionally, other silicone materials wherein the side chain groups $R_6$ and $R_7$ are alkyl, aryl, or mixed alkyl and aryl hydrocarbyl groups exhibit useful antifoaming properties. These materials are readily prepared by the hydrolysis of the appropriate alkyl, aryl or mixed alkylaryl silicone dichlorides with water in the manner well known in the art. Specific examples of such silicone antifoaming agents useful herein include diethyl polysiloxanes, dipropyl polysiloxanes, dibutyl polysiloxanes, methylethyl polysiloxanes, phenylmethyl polysiloxanes, and the like. The dimethyl polysiloxanes are particularly useful herein due to their low cost and ready availability.

A second type of silicone antifoaming agent useful in the detergent compositions herein comprises a mixture of an alkylated siloxane of the type hereinabove disclosed and silica. Such mixtures of silicone and silica can be prepared by affixing the silicone to the surface of silica ($SiO_2$), for example by means of the catalytic reaction disclosed in U.S. Pat. No. 3,235,509. Antifoaming agents comprising mixtures of silicone and silica prepared in this manner preferably comprise silicone and silica in a silicone:silica ratio of from 19:1 to 1:2, preferably 10:1 to 1:1. The silica can be chemically and/or physically bound to the silicone in an amount which is preferably from about 10% to about 15% by weight, based on the silicone. The particle size of the silica employed in such silica/silicone antifoaming agents should preferably be not more than 100 millimicrons, and the specific surface area of the silica should exceed about 50 $m^2/g$.

Alternatively, antifoaming agents comprising silicone and silica can be prepared by admixing a silicone fluid of the type hereinabove described with a hydrophobic silica having a particle size and surface area in the range described above. Any of several known methods may be used for making a hydrophobic silica which can be employed herein in combination with a silicone as the silicone antifoaming agent herein. For example, a fumed silica can be reacted with a trialkyl chlorosilane (i.e., "silanated") to affix hydrophobic trialkylsilane groups on the surface of the silica. In a preferred and well known process, fumed silica is contacted with trimethylchlorosilane and a preferred hydrophobic silanated silica useful in the present compositions is secured.

In an alternate procedure, a hydrophobic silica useful in the present compositions is obtained by contacting silica with any of the following compounds: metal, ammonium and substituted ammonium salts of long chain fatty acids, such as sodium stearate, aluminum stearate, and the like; silylhalides, such as ethyltrichlorosilane, butyltrichlorosilane, tricyclohexylchlorosilane, and the like; and long chain alkyl amines or ammonium salts, such as cetyl trimethyl amine, cetyl trimethyl ammonium chloride, and the like.

A preferred silicone antifoaming agent herein comprises a hydrophobic silanated (most preferably trimethylsilanated) silica having a particle size in the range from about 10 millimicrons to 20 millimicrons and a specific surface area above about 50 $m^2/g$ intimately admixed with a dimethyl silicone fluid having a molecular weight in the range from about 500 to about 200,000, at a weight ratio of silicone to silanated silica of from about 19:1 to about 1:2. Such silicone antifoaming agents preferably comprise silicone and the silanated silica in a weight ratio of silicone:silanated silica of from about 10:1 to 1:1. The mixed hydrophobic silanated (especially trimethylsilanated) silica-silicone antifoaming agents provide foam control over a broad range of temperatures, presumably due to the controlled release of the silicone from the surface of the silanated silica.

Yet another suitable silicone antifoaming agent comprises a silicone fluid, a silicone resin and silica. The silicone fluids useful in such mixtures are any of the types hereinabove disclosed, but are preferably dimethyl silicones. The silicone "resins" used in such compositions can be any alkylated silicone resins, but are usually those prepared from methysilanes. Silicone resins are commonly described as "three-dimensional" polymers arising from the hydrolysis of alkyl trichlorosilanes, whereas the silicone fluids are "two-dimensional" polymers prepared from the hydrolysis of dichlorosilanes. The silica components of such compositions are the microporous materials such as the fumed silica aerogels and xerogels having the particle sizes and surface areas hereinabove disclosed.

The mixed silicone fluid/silicone resins/silica materials useful in the present compositions can be prepared in the manner disclosed in U.S. Pat. No. 3,455,839. These mixed materials are commercially available from the Dow Corning Corporation. According to U.S. Pat. No. 3,455,839, such materials can be described as mixtures consisting essentially of:

(a) from about 10 parts to about 100 parts by weight of a polydimethylsiloxane fluid having a viscosity in the range from 20 cs. to 1500 cs. at 25° C.;

(b) 5 to 50 parts by weight of a siloxane resin composed of $(CH_3)_3\ SiO_{1/2}$ units and $SiO_2$ units in which the ratio of the $(CH_3)_3SiO_{1/2}$ units to the $SiO_2$ units is within the range of from 0.6/1 to 1.2/1; and (c) 1 to 10 parts by weight of a silica aerogel.

Such mixtures can also be sorbed onto and into a water-soluble solid as disclosed above.

Dispersants are preferably used in the detergent composition in conjunction with the silicone antifoaming agents therein. Silicone antifoaming agents are generally not readily dispersible in aqueous surfactant systems. Such dispersants are well known in the art and include, for example, nonionic cosurfactants.

Self-emulsified silicone antifoaming agents can also be used thus obviating or minimizing the desirability of adding dispersants to the detergent composition. These antifoaming agents are highly dispersible in aqueous surfactant systems. Self-emulsified silicone antifoaming agents are characterized by an emulsifying component of the silicone structure. Preferred self-emulsified silicones are those which contain emulsifiers which have at least one polyoxyalkylene moiety incorporated into a basic polysiloxane structure. The polyoxyalkylene moieties are preferably incorporated as polymer groups substituted on silicone atoms and pendant on the basic polysiloxane chain. However, provided that the silicone compound is rendered into an emulsifier, the polyoxyalkylene moieties can be in other positions and may, for example, form a part of the basic polymer chain, e.g., as a block copolymer. The use of these preferred emulsifier moieties in the silicone structure permits the inclusion of the silicone antifoaming agent in an aqueous, alkaline crutcher mix, and the formation of a spray-dried, granular detergent composition containing the silicone antifoaming agent in active form.

Highly-preferred self-emulsified silicones of the type described above are typically represented by the formula $$R_aSiY_{4-a}$$

wherein a is 0 or an number from 1 to 3, R is selected from the group consisting of (a) alkyl groups containing from 1 to about 30 carbon atoms, (b) groups having the formula $$—R'—(OR)_bOR''$$

wherein R' is an alkylene group containing 1 to about 6, preferably from 2 to 4 carbon atoms, b has a value of from 1 to about 100; and R" is a capping group which can be selected from the group consisting of hydrogen, alkyl, aryl, alkylaryl, aralkyl or alkenyl groups containing up to 20 carbon atoms; acyl groups containing up to 20 carbon atoms, sulfate, sulfonate, phosphate, phosphonate, borate or isocyanate groups, or mixtures thereof; and Y is a group having the formula

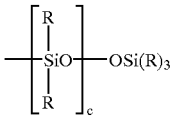

wherein R has the formula given bereinbefore, and c has a value from 1 to 200; and wherein at least one R group in the compound has the aforesaid formula $$(—R'(OR')_b—R'')$$

in which b is sufficiently large to create an emulsifier.

Preferred emulsifiers and self-emulsified silicone antifoaming agents containing them are described in Morehouse, U.S. Pat. Nos. 3,233,986 and 3,511,788, which descriptions are incorporated herein by reference. The agents described in U.S. Pat. No. 3,511,788 are most preferred. Preferred combinations of these emulsifiers together with silicone antifoaming agents are disclosed in British Patent 1,373,903 and U.S. Pat. No. 3,746,653, which patents are incorporated herein by reference. Preferably, the mixtures will contain at least 50% of $R_aSiY_{4-a}$, from about 5% to about 45% of a polydimethylsiloxane liquid and from 0.05% to about 5% of silica. The mixture can additionally comprise a minor amount of a polydimethylsiloxane resin.

Other effective self-emulsified silicone antifoaming agents are those which contain a high ethoxylate of a fatty acid as the emulsifying component. The condensation products of from about 300 to about 2,000 moles of ethylene oxide for each mole of fatty acid are particularly useful. Fatty acids are straight-chain saturated and unsaturated monocarboxylic acids, usually containing an even number of carbon atoms (from about 10 to about 20), preferably around eighteen in number. Examples of common fatty acids include palmitic acid, stearic acid and oleic acid.

The emulsifying component may also be a zwitterionic surfactant. Zwitterionic surfactants useful herein include derivatives of aliphatic quaternary ammonium, phosphonium an sulfonium compounds in which the aliphatic moieties can be straight or branched chain, and wherein one of the aliphatic substituents contains an anionic water-solubilizing group. Preferred zwitterionic materials are the ethoxylated ammonium sulfonates and sulfates disclosed in U.S. Pat. No. 3,925,262 (Laughlin et al.), which patent is incorporated herein by reference.

The concentrated compositions of the present invention comprise from about 0.01% to about 0.6%, preferably from about 0.02% to about 0.4%, more preferably from about 0.03% to about 0.3%, of the silicone antifoaming agent by weight of the detergent composition. The concentrated composition as diluted and the ready to use formula both provide from about 1 ppm to about 40 ppm, preferably from 5 ppm to about 35 ppm, more preferably from about 5 ppm to about 20 ppm, of the silicone antifoaming agent to the solution used to clean the floor. The amount of silicone antifoaming agent selected for use in the composition will depend upon the variables described hereinbefore and especially upon the formulation of the floor cleaning compositions (e.g. liquid or nonliquid formulations).

Protonated Amine

An optional ingredient, but one that is highly preferred for the concentrated compositions of the present invention which have a pH greater than about 7, is a protonated amine. It is beneficial to incorporate the use of a protonated amine into the compositions in order to reduce or eliminate the staining of vinyl floor surfaces. Vinyl staining comes from the dehydrochlorination of polyvinyl chloride surfaces. Dehydrochlorinated polyvinyl chloride has a yellow to brown appearance, depending on the degree of dehydrochlorination. It is believed that this dehydrochlorination reaction is initiated by amine oxide surfactants. By protonating the amine oxide to the extent described herein, the rate of dehydrochlorination is greatly reduced, and vinyl staining is reduced or eliminated. In the compositions of the present invention, the protonated amine oxides cannot initiate the dehydrochlorination reaction, thereby eliminating the staining effect.

The amine oxide cannot be protonated directly to a significant amount at pH's above about 6.0. Amine oxides generally have pKa's of about 4.5 so at a pH of 6.0, the level of protonated amine is less than 0.1%. To prevent staining under mildly acidic to alkaline conditions, we have found that we can add a protonated amine to ion-pair with the amine oxide (Wierenga et. al., U.S. Pat. No. 5,691,291).

The compositions of the present invention can comprise a molar ratio of protonated amine to amine oxide from about 2:1 to 1:10, preferably from about 2:1 to 1:5 and more preferably 1:1.

Any amine capable of being protonated is useful in the composition. Preferably the amine is a protonated primary, secondary or tertiary amine. Preferred amines are 2-amino-2-methyl-1-propanol (AMP) and monoethanolamine (MEA).

Amines are generally chosen based on the desired pH of the composition. Generally the compositions of the present invention have a pH of from about 3 to about 10, preferably from about 5.5 to about 10, more preferably from about 7 to about 10, and most preferably from about 7.5 to about 10. The amine will have a pKa about the desired pH of the composition. Preferably the $pK_a$ of the amine is about 0.5 units, more preferably about 1.0 units, and most preferably about 1.5 units, above the pH of the composition. A $pK_a$ about 1.5 units above the desired pH of the composition will minimize the amount of amine necessary to achieve the target molar ratio of protonated amine to amine oxide, since essentially all of the amine will be protonated under such conditions. An amine having a $pK_a$ less than about 1.5 units greater than the pH of the composition may be used, or a composition pH can be selected which is greater than 1.5 units below the $pK_a$ of the amine used, however, as the degree of protonation of the amine decreases as the pH of the composition is increased above about 1.5 units below the $pK_a$ of the amine, relatively more of the amine will be required to achieve the target molar ratio of protonated amine to amine oxide.

The following non-limiting discussion illustrates one method for the calculation of the level of a selected protonated amine used to maintain a 1:1 molar ratio with a selected amine oxide based on the Bronsted theory of acid/base chemistry. In the Bronsted theory of acids and bases, an acid is any substance, compound or species that can lose a proton (hydrogen ion), while a base is any substance, compound or species that can accept a proton as the following equation demonstrates:

$$HA \leftrightarrows H^+ + A^- \quad (1)$$

HA is the Bronsted acid, and $A^-$ is its conjugate base. The dissociation constant ($K_a$) for equation (1) is:

$$K_a = [H^+][A^-]/[HA] \quad (2)$$

Using the Bronsted definition of acids and bases, a protonated amine is an acid because it can lose a proton as the following equation demonstrates with protonated monoethanolamine ($MEA\text{-}H^+$):

$$MEA\text{-}H^+ \leftrightarrows H^+ MEA$$

$$K_a = [H^+][MEA]/[MEA\text{-}H^+] \quad (3)$$

The total concentration of MEA ($C_{MEA}$) can be defined as:

$$C_{MEA} = [MEA\text{-}H^+] + [MEA] \quad (4)$$

The fraction of the MEA in its acid form ($\alpha_{MEA\text{-}H}^+$) can be defined as:

$$\alpha_{MEA\text{-}H}^+ = [MEA\text{-}H^+]/C_{MEA} \quad (5)$$

Substituting equations (3) and (4) into equation (5), equation (5) can be reduced to:

$$\alpha_{MEA\text{-}H}^+ = [H^+]/([H^+] + K_a) \quad (6)$$

The following non-limiting example will be used to calculate how much MEA must be added to a floor cleaning composition at pH=8.0 to form a 1:1 molar ratio between lauryl dimethylamineoxide and $MEA\text{-}H^+$. Monoethanolamine has a $pK_a$ of 9.44, as set forth in *Biochemical Calculations* 2*nd ed*., I. H. Segal, John Wiley & Sons, Inc., 1976, p. 406. Substituting the $K_a$ for $MEA\text{-}H^+$ and the desired composition pH into equation (6) gives:

$$\alpha_{MEA\text{-}H}^+ = (10^{-8})/(10^{-9.44} + 10^{-8}) = 0.96 \text{ or } 96\% \text{ protonated at pH } 8.0$$

A formula containing 9% lauryl dimethylamine oxide (MW of 229) would need 2.5% MEA (MW of 61) to maintain a 1:1 molar ratio between $MEA\text{-}H^+$ and lauryl dimethylamine oxide at pH 8.0:

$$(9\% \text{ amine oxide}/229)*(61)/(0.96) = 2.5\% \text{ MEA}$$

MEA can be used in a more alkaline formula to prevent staining as long as the concentration of MEA is increased to maintain the 1:1 molar ratio of protonated amine to amine oxide. For example, at a formula pH of 9.0, the MEA level of the composition must be increased to 3.28% to prevent vinyl staining:

$$\alpha_{MEA\text{-}H}^+ = (10^{-9})/(10^{-9.44} + 10^{-9}) = 0.73 \text{ or } 73\% \text{ protonated at pH } 9.0$$

$$(9\% \text{ amine oxide}/229)*(61)/(0.73) = 3.28\% \text{ MEA}$$

Further discussion of acid-base equilibria can be found in the chapter entitled Acid-Base Equilibria in Water from the text *Chemical Analysis* 2*nd ed*., H. A. Laitinen and W. E. Harris, McGraw-Hill, Inc., 1975.

Preferably the amine will have a $pK_a$ of from about 6.5 to about 14, more preferably from about 7.5 to about 10.5. Values for $pK_a$ of various amines can be found in literature references such as *Biochemical Calculations* 2*nd ed*., I. H. Segal, John Wiley & Sons, Inc., 1976; *CRC Handbook of Chemistry and Physics* 62*th ed*., The Chemical Rubber Company, 1981; and *The Merck Index* 11*th ed*., Merck & Co., 1989. Additionally, one of ordinary skill will appreciate that the $pK_a$ of a compound can be calculated through titration. Examples of such calculations are set forth in references such as *Chemical Analysis* 2*nd. ed*., H. A. Laitinen and W. E. Harris, McGraw-Hill, Inc., 1975, Chapter 3, pages 27–53, incorporated herein by reference.

An acid can serve as a proton source for the protonation of the amine; preferably the acid will be a strong mineral acid. Suitable mineral acids include hydrochloric, phosphoric, perchloric and nitric acids; preferred acid include hydrochloric acid, phosphoric acid and mixtures thereof. The acid is present at a level sufficient to protonate at least a portion of the amine, such that the resulting protonated amine is present in the composition at a molar ratio of protonated amine to amine oxide of at least about 0.1:1. The concentrated composition generally contains from about 1% to about 10%, preferably from about 1% to about 7%, more preferably from about 1% to about 6% of acid; preferably the acid is phosphoric acid, hydrochloric acid, or mixtures thereof.

Auxiliary Ingredients

The floor cleaning compositions of the present invention may further comprise one or more additional ingredients which augment cleaning and aesthetics.

The compositions of the present invention can optionally comprise a non-interfering auxiliary surfactant in addition to the amine oxide and nonionic detergent surfactants. Additional auxiliary surfactants can effect cleaning activity. A wide variety of organic, water soluble surfactants can optionally be employed. The choice of auxiliary surfactant depends on the desires of the user with regard to the intended purpose of the compositions and the commercial availability of the surfactant. Compositions used for 14 cleaning finished floors preferably comprise surfactants which do not strip the finish, and are preferably substantially free of surfactants which do strip the finish. A preferred optional ingredient for use in the floor cleaning compositions of the present invention is oleoyl sarcosine in its acid and/or salt form. Suitable oleoyl sarcosines have the formula:

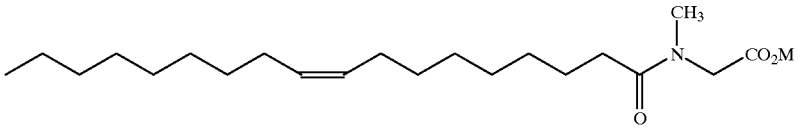

wherein M is hydrogen or a cationic moiety. Preferred M are hydrogen and alkali metal salts, especially sodium and potassium. The concentrated compositions disclosed herein comprise from about 0% to about 9%, preferably from about 0.2% to about 8%, more preferably from about 2% to about 5%, of oleoyl sarcosine. The concentrated composition as diluted and the ready to use formula both provide from about 50 ppm to about 400 ppm, preferably about 75 ppm to about 300 ppm and most preferably from about 75 ppm to about 250 ppm oleoyl sarcosine to the solution used to clean the floor.

Oleoyl sarcosine is commercially available from Hampshire Chemical Corporation. In addition to the commercially available oleoyl sarcosine, the oleoyl sarcosine useful herein can also preferably be prepared from the ester (preferably the methyl ester) of oleic acid and a sarcosine salt (preferably the sodium salt) under anhydrous reaction conditions in the presence of a base catalyst with a basicity equal to or greater than alkoxide catalyst (preferably sodium methoxide). Oleoyl sarcosine is preferred for use herein because of its biodegradeability.

A second preferred auxiliary surfactant is from the Polyterg C series. Polyterg C series surfactants are proprietary multifunctional carboxylated alcohol alkoxylate surfactant with the general formula:

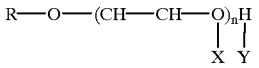

wherein R is a hydrocarbon containing group having from about 6 to about 18 carbon atoms. X and Y are individually chosen from H, CH3 or a succinic acid radical having the following structure:

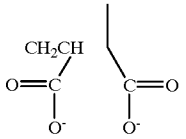

The preferred Polyterg C series surfactant is C9-51P where R=C9 and the weight % of hydrophile (X+Y) equals 51% and the molecule contains some propylene oxide (X or Y=$CH_3$). Polyterg C9-51 P is commercially available from BASF Corporation.

Detergent Builders

Detergent builders can also be employed in the compositions. Detergent builders sequester calcium and magnesium hardness ions that might otherwise bind with and render less effective the auxiliary surfactants or cosurfactants. Builders are especially useful when auxiliary surfactants or cosurfactants are employed, and are even more useful when the compositions are diluted prior to use with exceptionally hard tap water., e.g., above about 12 grains/gallon. The detergent builders can be employed in the compositions at concentrations of between about 0 and about 10%.

Other optional additives such as thickeners, hydrotropes, dyes, sequestrants, perfumes, salts, brighteners, enzymes, colorants, and the like can be employed in the compositions to enhance aesthetics and/or cleaning performance. These additives must be compatible with the active components in the composition, and they should not interfere with the inhibition of vinyl staining as discussed herein.

Method of Use

The floor cleaning compositions of the present invention may be used in accordance with conventional or otherwise known industrial floor cleaning methods and equipment to provide cleaning and enhanced burnish response benefits.

A preferred method for cleaning large floor surfaces utilizes an automatic scrubber. Such automatic scrubbers are commercially available, and automatically apply the cleaning composition, scrub the floor, and squeegee to remove used cleaning composition. One preferred method for cleaning floors with an automatic scrubber utilizes a diluted cleaning composition which is prepared by adding tap water to the concentrated cleaning composition at a ratio of about 1:256 parts concentrated cleaning composition to water. The resulting diluted composition comprises from about 100 ppm to about 350 ppm of amine oxide detergent, from about 0 ppm to about 200 ppm of nonionic surfactant; and from about 5 ppm to about 10 ppm silicone antifoam agent.

In another preferred method, the concentrated floor cleaning composition is first diluted with water at a ratio of about 1:128 parts concentrated cleaning composition to water. The diluted composition comprises from about 200 ppm to about 700 ppm of the amine oxide detergent surfactant described herein. The diluted composition also comprises nonionic surfactant at a level of from about 0 ppm to about 500 ppm, and additionally comprises a silicone antifoam agent at a level of from about 10 ppm to about 20 ppm. The diluted composition is then applied to the floor using a mop and allowed to dry without rinsing.

Method of Making

The floor cleaning compositions of the present invention are prepared by the following method:

A Place about 75% of the required amount of soft, deionized water (100° F.) in an appropriately sized vessel. While stirring at 200–300 rpm, add the silicone suds suppressor and agitate for 10 minutes. If the formula requires a thickener, it is added at this point and the solution is stirred for 20–30 minutes to completely wet the thickener. Slowly add the amine oxide and mix for 3–5 minutes. Slowly add any auxiliary surfactants (Neodol 1–5, Oleoyl Sarcosine, CS-1, etc.) sequentially, mixing for 10 minutes between additions. If the finished pH will be above about 6.0, slowly add the amine and mix for 10 minutes. Add any additional auxiliary materials (KCl, DTPA, builders, etc.) and continue mixing for 10 minutes. Carefully add 90% of the HCl and mix for at least 10 minutes. Insert a pH meter into the solution, and slowly add additional HCl until the target pH is achieved. Add the dye and perfume and mix for an additional 10 minutes. Add soft, deionized water needed to bring the formula to 100%.

EXAMPLES

The compositions illustrated in the following examples illustrate specific embodiments of the floor cleaning compositions of the present invention, but are not intended to be limiting thereof. Other modifications can be undertaken by the skilled artisan without departing from the spirit and scope of this invention. These illustrated embodiments of the present invention provide excellent floor cleaning with enhanced burnish response for floors in the commercial market.

The following examples illustrate floor cleaning compositions that have improved burnish response. The representative cleaning compositions are diluted 1:128 when applied to the floor using a mop and bucket and 1:256 when applied to the floor using an autoscrubber.

Example I

| Formula Component | % By Weight | 1:128 Dilution | 1:256 Dilution |
|---|---|---|---|
| Silicone AF-GPC | 0.128 | 10 ppm | 5 ppm |
| Thickener[1] | 0.44 | 34 ppm | 17 ppm |
| C12-14 Amine Oxide | 9.00 | 703 ppm | 352 ppm |
| Oleoyl Sarcosine | 0.50 | 39 pm | 19 ppm |
| Hydrochloric acid/MEA | To Target pH | — | — |
| Perfume/Dye | 0.102 | 8 ppm | 4 ppm |
| Water | q.s. to 100% | | |
| pH = 7.0 | | | |

[1]Union Carbide Hydroxyethyl Cellulose QP 4400

Example II

| Component | % By Weight | 1:128 Dilution | 1:256 Dilution |
|---|---|---|---|
| Silicone AF-DSE | 0.10 | 7.8 ppm | 3.9 ppm |
| Silicone AF-GPC | 0.10 | 7.8 ppm | 3.9 ppm |
| C12-14 Amine Oxide | 3.50 | 273 ppm | 137 ppm |
| Neodol 1–5 | 4.50 | 352 ppm | 176 ppm |
| Oleoyl Sarcosine | 2.00 | 156 ppm | 78 ppm |
| AMP | 1.48 | 116 ppm | 58 ppm |
| KCl | 0.50 | 39 ppm | 20 ppm |
| DTPA | 0.10 | 7.8 ppm | 3.9 ppm |
| Hydrochloric acid | 0.34 | 27 ppm | 13 ppm |
| Dye/Perfume | 0.11 | 8.6 ppm | 4.3 ppm |
| Deionized Water | q.s. to 100% | | |
| pH = 7.5 | | | |

Example III

| Formula Component | % By Weight | 1:128 Dilution | 1:256 Dilution |
|---|---|---|---|
| Silicone AF-GPC | 0.128 | 10 ppm | 5 ppm |
| C12-14 Amine Oxide | 9.00 | 703 ppm | 352 ppm |
| Monoethanolamine | 3.3 | 258 ppm | 129 ppm |
| Hydrochloric acid | 5.6 | 156 ppm | 78 ppm |
| Perfume/Dye | 0.8 | 8 ppm | 4 ppm |
| Water | q.s. to 100% | | |
| pH = 9 | | | |

Example IV

| Formula Component | % By Weight | 1:128 Dilution | 1:256 Dilution |
|---|---|---|---|
| Silicone AF-GPC | 0.128 | 10 ppm | 5 ppm |
| C12-14 Amine Oxide | 9.00 | 703 ppm | 352 ppm |
| t-Butyl amine | 3.3 | 39 pm | 19 ppm |
| Hydrochloric acid | 4.5 | 126 ppm | 63 ppm |
| Perfume/Dye | 0.8 | 8 ppm | 4 ppm |
| Water | q.s. to 100% | | |
| pH = 10 | | | |

[1]Union Carbide Hydroxyethyl Cellulose QP 4400

What is claimed is:

1. A method for providing improved burnish response to floors comprising the steps of:

a) providing a concentrated floor cleaning composition which provides improved burnish response to floors, consisting essentially of, by weight:
   (i) from about 1% to about 15% of an amine oxide surfactant;
   (ii) from about 0% to about 15% of a nonionic surfactant;
   (iii) from about 0.01% to about 0.6% of a silicone antifoam agent;
   wherein the pH of the concentrated composition is from about 7 to about 10;

b) making a ready-to-use floor cleaning composition comprising:
   (i) from about 100 ppm to about 750 ppm of an amine oxide surfactant;
   (ii) from about 0 ppm to about 650 ppm of a nonionic surfactant;
   (iii) from about 1 ppm to about 40 ppm of a silicone antifoam agent; and
   wherein the pH of the ready-to-use composition is from about 3 to about 10;

c) dispensing said ready-to-use composition into an autoscrubber; and d) using said autoscrubber to scrub the floor.

2. A method for providing improved burnish response to floors comprising the steps of:

a) dispensing a ready-to-use floor cleaning composition comprising:
   (i) from about 100 ppm to about 750 ppm of an amine oxide surfactant;
   (ii) from about 0 ppm to about 650 ppm of a nonionic surfactant;
   (iii) from about 1 ppm to about 40 ppm of a silicone antifoam agent;

into a bucket, wherein the pH of the ready-to-use composition is from about 3 to about 10;

b) applying said composition to the floor using a mop; and c) allowing the floor to dry without rinsing.

3. A method for providing improved burnish response to floors by using a ready-to-use floor cleaning composition comprising the steps of:

a) providing a ready-to-use floor cleaning composition comprising:
   (i) from about 100 ppm to about 750 ppm of an amine oxide surfactant;
   (ii) from about 0 ppm to about 650 ppm of a nonionic surfactant;
   (iii) from about 1 ppm to about 40 ppm of a silicone antifoam agent; and wherein the pH of the ready-to-use composition is from about 3 to about 10 b) applying said ready-to-use composition to a floor with a finish, c) softening said finish;

d) allowing said finish to reharden by evaporation.

4. A method for providing improved burnish response to floors by using a concentrated floor cleaning composition comprising the steps of:

a) providing a concentrated floor cleaning composition comprising:

(i) from about 1% to about 15% of an amine oxide surfactant;

(ii) from about 0% to about 15% of a nonionic surfactant;

(iii) from about 0.01% to about 0.6% of a silicone antifoam agent;

wherein the pH of the concentrated composition is from about 7 to about 10, b) making a ready-to-use floor cleaning composition comprising:

(i) from about 100 ppm to about 750 ppm of an amine oxide surfactant;

(ii) from about 0 ppm to about 650 ppm of a nonionic surfactant;

(iii) from about 1 ppm to about 40 ppm of a silicone antifoam agent; and wherein the pH of said ready-to-use composition is from about 3 to about 10, c) applying said ready-to-use composition to a floor with a finish;

d) softening said finish;

e) allowing said finish to reharden by evaporation.

* * * * *